US007422473B2

(12) United States Patent
Portwood

(10) Patent No.: US 7,422,473 B2
(45) Date of Patent: Sep. 9, 2008

(54) POWER ADAPTER CABLE WITH COMMONLY CONFIGURED INTERFACES

(75) Inventor: Daniel Portwood, Fort Lauderdale, FL (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 11/590,928

(22) Filed: Nov. 1, 2006

(65) Prior Publication Data

US 2007/0105424 A1 May 10, 2007

Related U.S. Application Data

(60) Provisional application No. 60/731,865, filed on Nov. 1, 2005.

(51) Int. Cl.
*H01R 13/72* (2006.01)

(52) U.S. Cl. ..... 439/501; 363/144

(58) Field of Classification Search ..... 439/638, 439/441, 639, 676; 363/144; 307/117
See application file for complete search history.

(56) References Cited

U.S. PATENT DOCUMENTS 5,359,540 A * 10/1994 Ortiz ..... 700/295
5,548,467 A * 8/1996 Heaney et al. ..... 361/93.7
5,649,829 A * 7/1997 Miller et al. ..... 439/76.1
6,057,610 A * 5/2000 Nierescher ..... 307/72
6,211,581 B1 * 4/2001 Farrant ..... 307/117
6,266,261 B1 * 7/2001 Lanni ..... 363/144

* cited by examiner

*Primary Examiner*—Jean F Duverne
(74) *Attorney, Agent, or Firm*—Wesley W. Muller

(57) ABSTRACT

A power cable having a commonly configured interface at either end of the cable is provided. The power cable is used to connect a power source to a power inverter or to provide power from the power inverter to a device. The power cable has two ends each provided with a commonly configured interface. The commonly configured interface may be a plug or a plug receptacle. A plurality of different adapters for various power sources or devices may be coupled to the commonly configured interface. The adapters may be provided with a corresponding interface that plugs into or is received by the commonly configured interface at an end of the cable.

14 Claims, 4 Drawing Sheets

POWER ADAPTER CABLE WITH COMMONLY CONFIGURED INTERFACES

BACKGROUND OF THE INVENTION

Field of the Invention

Today, people are highly mobile and require that their electronic tools with which they conduct their business be likewise mobile. Part of meeting that requirement is to provide portable electronic devices, such as cellular phones and laptop computers, with the power those devices need. Portable devices are usually equipped with rechargeable batteries, but even the most expensive and heavy batteries are rarely sufficient to deliver electrical power over a significant time period. These batteries need to be recharged periodically from various power sources, sometimes on the road.

Accordingly, portable devices are often equipped with power adapters for charging their batteries. The most common of these adapters plug directly into a wall outlet or socket. Some adapters are designed to plug into the power outlet, more commonly known as the cigarette lighter socket with which most automobiles—and some boats and other vehicles—are equipped. Still others are designed to plug into power sockets on passenger airplanes.

Each of these electronic tools may have a different receptacle to interface with the power adapter. For example, a cellular telephone may be charged via a USB interface, whereas a laptop computer may be recharged via a pin connection. Consequently, mobile people such as business travelers are often required to carry numerous different power adapters. Power adapters are bulky and carrying them is inconvenient.

Universal power adapters have been introduced. However, universal power adapters require many different adapters and power cables. Each of the power cables may only be configured to interface with one or two power sources, adapters or devices. Moreover, one end of the power cable is adapted to interface with a power adapter, whereas the other end of the cable is specially configured to interface with a particular device. Finding the appropriate cable or plug to go with the particular device being recharged or power source can be a frustrating experience.

Accordingly, there is a need for a simplified apparatus that can be used with a plurality of different power sources and devices.

SUMMARY OF THE INVENTION

Embodiments of the present invention provide a power system. The power system comprises a power cable including at least two ends having a commonly configured interface; a plurality of power adapters each having an interface configured to mate with the commonly configured interface.

In a further embodiment, the power system comprises a power inverter including an input port or an output port having an interface configured to mate with the commonly configured interface.

In a further embodiment, the commonly configured interface is a plug receptacle and the power adapter interface is a plug corresponding to the plug receptacle.

Further objectives and advantages, as well as the structure and function of exemplary embodiments will become apparent from a consideration of the description, drawings, and examples.

BRIEF DESCRIPTION OF THE DRAWINGS

The foregoing and other features and advantages of the invention will be apparent from the following, more particular description of an exemplary embodiment of the invention, as illustrated in the accompanying drawings wherein like reference numbers generally indicate identical, functionally similar, and/or structurally similar elements.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention.

Embodiments of the present invention relate to a power cable having a commonly configured interface at either end of the cable. The power cable may be used in conjunction with power inverters, power adapters, and other devices. In embodiments of the invention, the power cable may be used to connect a power source to a power inverter or to provide power from the power inverter to a device. The power cable has two ends each provided with a commonly configured interface. The commonly configured interface may be a plug or a plug receptacle. A plurality of different adapters for various power sources or devices may be coupled to the commonly configured interface. The adapters may be provided with a corresponding interface that plugs into or is received by the commonly configured interface at an end of the cable.

Embodiments of a power system including the above-described cable may also include a device such as a power inverter. The power inverter may include an interface that is adapted to couple with the commonly configured interface of the power cable. As such, any of the adapters for the power inverter may be plugged into either end of the cable. There is no need to search for the proper end of the cable to plug into the power inverter or to search for the appropriate adapter to fit a specific end of the cable. Any end of the cable with the commonly configured interface may be coupled with any of the adapters or with a device such as the power inverter, greatly simplifying the connection of the various power sources and devices to the power inverter.

Figure 1:
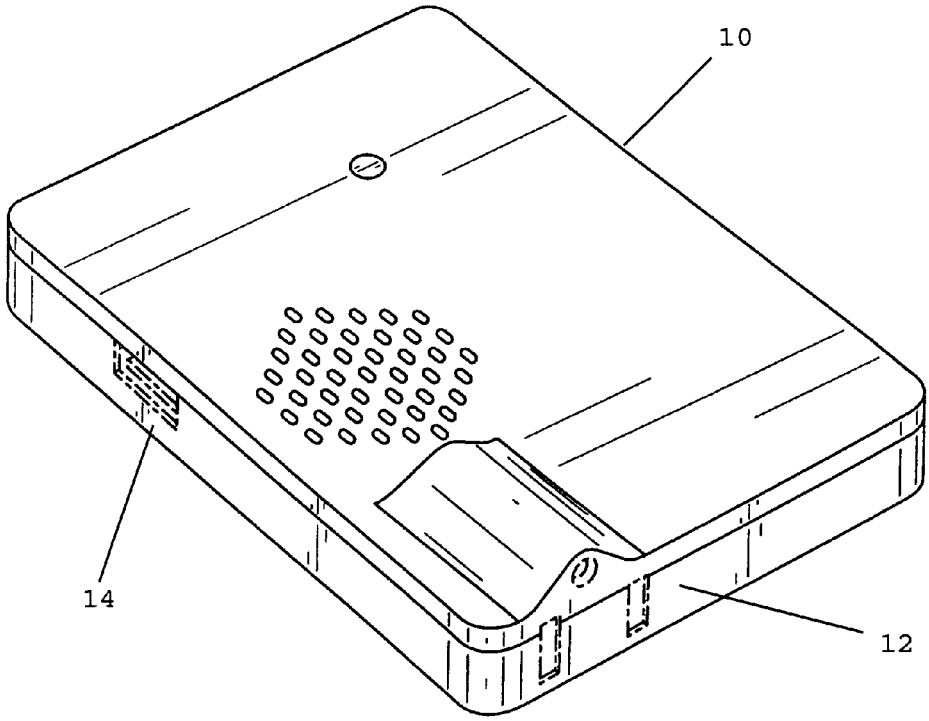
FIG. 1 is a perspective view of a power inverter according to an exemplary embodiment of the present invention.
Figure 2A:
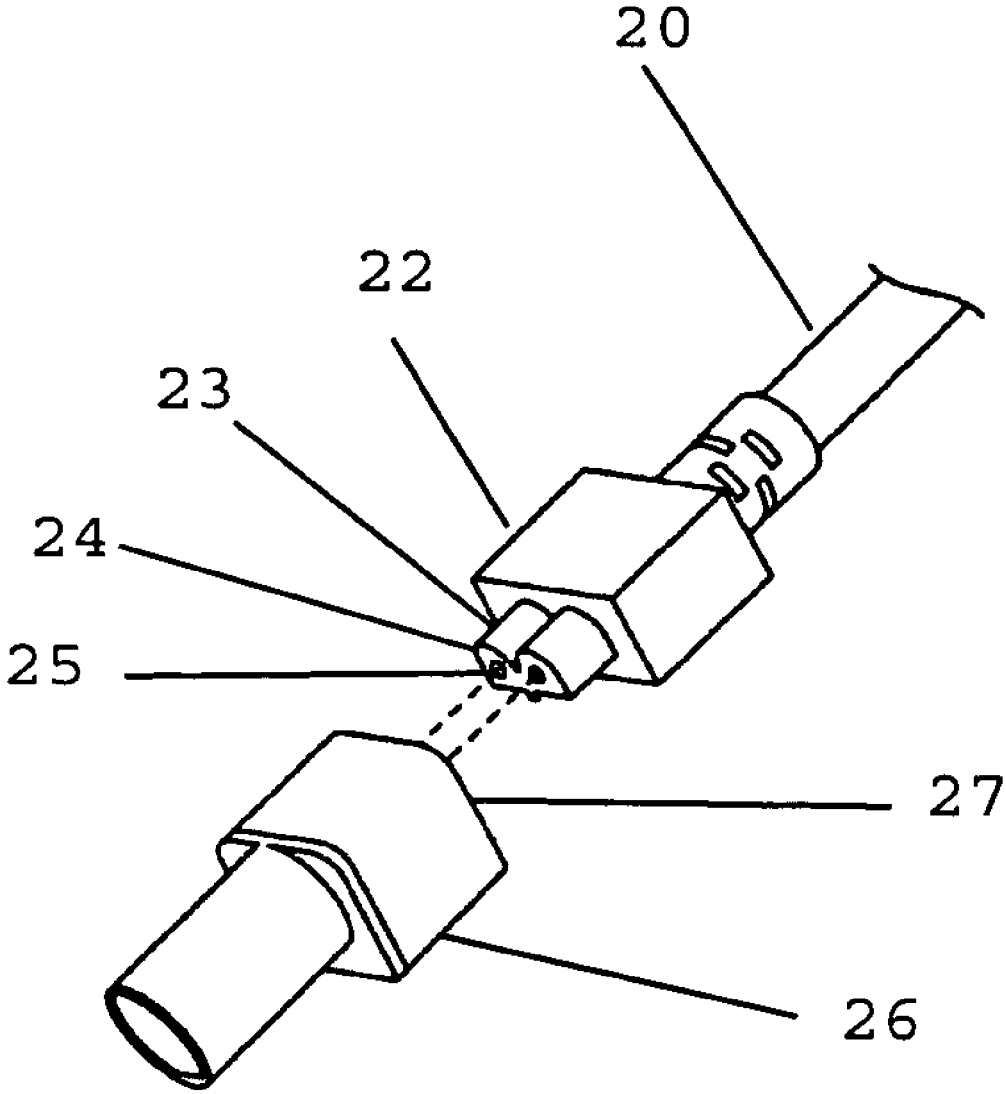
FIGS. 2A and 2B are views of a power cable and adapter according to an exemplary embodiment of the present invention.
Figure 2B:
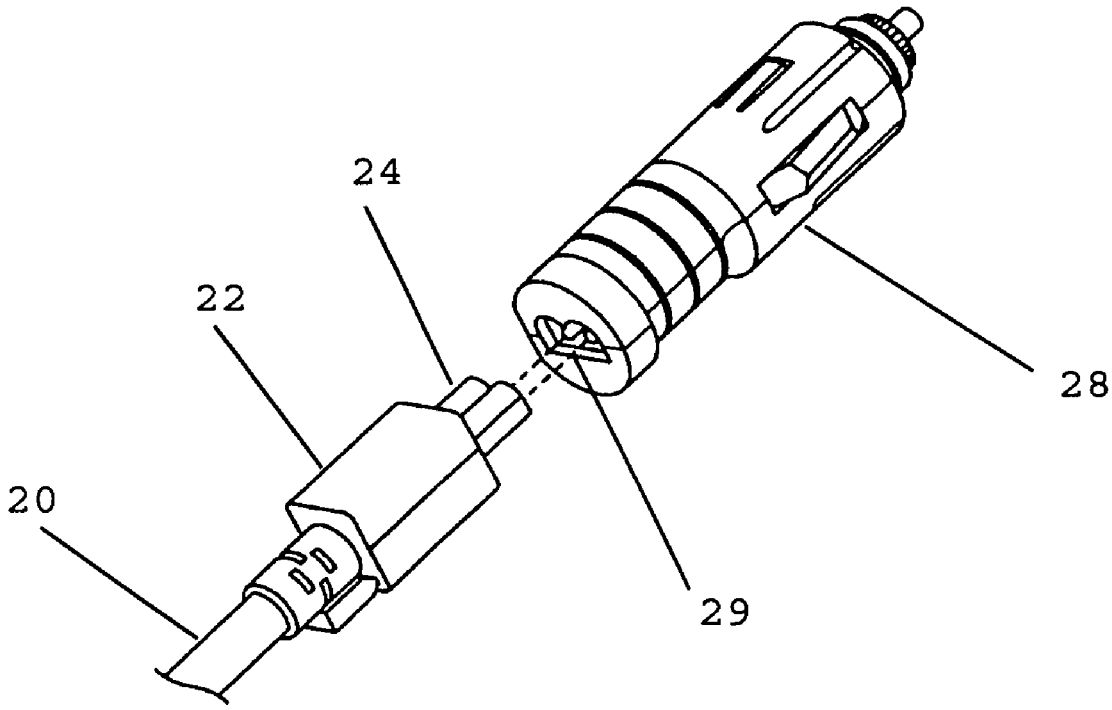

Referring now to FIG. 1, an exemplary embodiment of the present invention is described. In the example embodiment shown, a power inverter 10 is provided. The power inverter 10 converts a 12V DC input into a 120V household current output or a USB power output. Power converter circuitry (not shown) is provided in the power inverter 10 to convert the 12V DC input power into the AC power output. A voltage regulator converts the 12V DC input power into a USB compatible 5V/500 mA DC power output. The DC input may be provided, for example, via a cigarette lighter or DC accessory output in a vehicle or from an airline power outlet. The DC input is received at the power inverter 10 via a power cable. The power cable has two ends, each of which is provided with a commonly configured interface. The power cable is coupled at one end to the input port of the power inverter 10. The other end of the cable is adapted to connect to an adapter. FIG. 2A depicts an exemplary embodiment of the present invention where a power cable 20 has a commonly configured interface 22 and the adapter 26 is for an airline power socket. FIG. 2B depicts another exemplary embodiment where the adapter 28 is for a cigarette lighter socket. The adapters may be removable from the ends of the cable 20 such that the power inverter 10 can be used with multiple power sources.

A power cable 20 may also be provided from the power inverter 10 to the device requiring power. In the embodiment shown in FIG. 1, the power inverter 10 is provided with an output port 12 that includes a standard two or three prong AC power plug. A USB output port 14 that mates with a standard USB plug is also provided. In an exemplary embodiment, the USB output port 14 provides the 5V/500 mA DC power.

In another embodiment of the invention, the power cable 20 with the commonly configured interface 22 at each of its ends may be provided from the power inverter 10 to the device requiring power may be provided. The device requiring power may include a port that mates with the commonly configured interface 22. Alternatively, a plurality of different adapters for different devices may be provided. The adapters include an interface that mates with the commonly configured interface 22. Accordingly, the power inverter 10 may be used with a plurality of different devices or power sources.

In the embodiment illustrated in FIGS. 2A and 2B, the commonly configured interface 22 provided on each of the cable ends is a plug receptacle 23. The adapter 26 for an airline socket, shown in FIG. 2A, comprises a corresponding plug 27. Similarly, the adapter 28 for a cigarette lighter comprises a corresponding plug 29. The plug receptacle 23 as shown has a contoured housing 24, which may take essentially any form. Here, the housing 24 defines two receptacle holes 25 for receiving a corresponding plug or pin. The receptacle holes are generally circular in shape and arranged side-by-side. The contour of the housing 24 includes two elliptical portions surrounding either of the receptacle holes 25. The plug receptacles 23 at either end of the cable 22 should be essentially identical.

Figure 3:
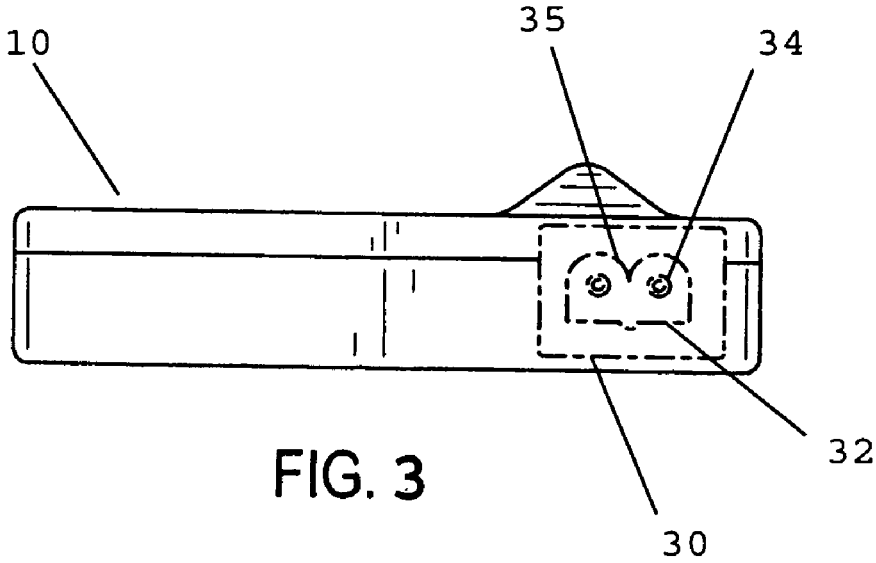
FIG. 3 is a rear view of the power inverter shown in FIG. 1.

FIG. 3 depicts an exemplary front view of the power inverter 10, including the input port 30. The input port 30 includes a plug 32 configured to interface with the plug receptacle 23 of the power cable 20. The plug 32 as illustrated includes two pins 34 arranged side-by-side. The pins 34 are generally circular in shape and extend from a recess in the power inverter housing. The pins 34 are adapted to be received in the corresponding plug receptacle. The recess has a contour 35 adapted to interface with the housing contour 24. As such, the shape of the recess should generally follow the contour of the plug receptacle 23. The input port 30 is configured to receive either end of the power cable 20. Accordingly, any of the cigarette lighter adapter, the airline power adapter, or the power inverter, may be coupled with either end of the power cable 20.

Figure 4:
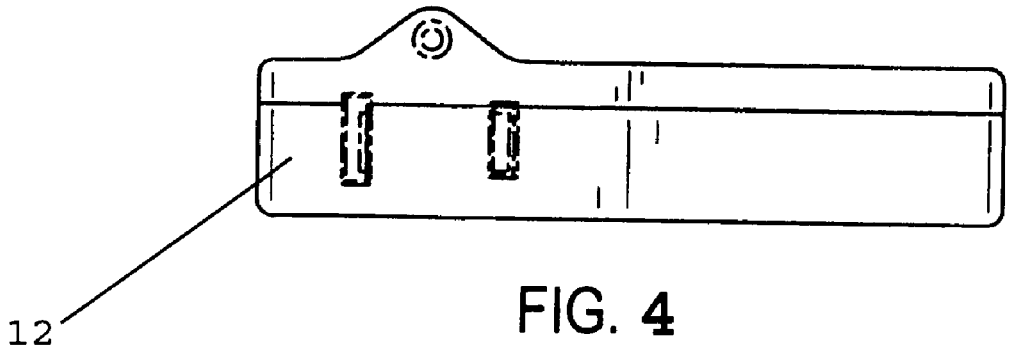
FIG. 4 is a front view of the power inverter shown in FIG. 1.

FIG. 4 depicts an exemplary front view of the power inverter 10, including the output port 12. The output port 12 includes a standard two or three prong AC power plug that mates with a standard two or three prong AC power plug receptacle at the end of a power cable 20.

Although the power cable 20 as shown in FIGS. 2A and 2B includes a plug receptacle and plugs are provided on the power adapter 26 and 28, the reverse may also be true. That is, the power cable may be provided with commonly configured plugs on each end and the adapters and power inverter may each be provided with a plug receptacle adapted to mate with the commonly configured plugs.

What is claimed is:

1. A power system comprising:

a power cable including at least two ends, each end having a commonly configured interface substantially identical to the other;

a power inverter including an input port and an output port, the input port having an interface configured to mate with the commonly configured interface; and a plurality of power adapters each having a first interface configured to mate with the commonly configured interface and a second interface configured to mate with a different power source, wherein a first end of the power cable mates with the input port of the power inverter and a second end of the power cable mates with one of the plurality of power adapters to couple the power cable to the power source.

2. The power system of claim 1, wherein the output port of the power inverter comprises a standard three prong AC power plug that mates with a standard two or three prong AC power plug receptacle, wherein the power inverter coverts a DC input to an AC output.

3. The power system of claim 2, wherein the AC output is a 120V household current output.

4. The power system of claim 1, wherein the output port of the power inverter comprises a USB output, wherein the power inverter coverts a DC input to a USB compatible DC power output.

5. The power system of claim 1 wherein the second interface of the power adapter mating with the power cable is for a cigarette lighter socket.

6. The power system of claim 1 wherein the second interface of the power adapter mating with the power cable is for an airplane power socket.

7. The power system of claim 1, wherein the output port of the power inverter has an interface configured to mate with the commonly configured interface of the power cable and the power cable couples the output port of the power inverter with a device, the device including a port adapted to mate with the commonly configured interface.

8. The power system of claim 1, wherein the commonly configured interface includes a plug receptacle and the first interface of the power adapter includes a plug corresponding to the plug receptacle.

9. The power system of claim 8, wherein the plug receptacle has a housing contour.

10. The power system of claim 9, wherein the housing defines two receptacle holes for receiving the corresponding plug.

11. The power system of claim 1, wherein the commonly configured interface includes a plug receptacle and the input port of the power inverter includes a plug configured to mate with the plug receptacle.

12. The power system of claim 11, wherein the plug includes two pins extending from a recess in the power inverter housing.

13. The power system of claim 12, wherein the plug receptacle has a housing contour and the recess has a contour adapted to interface with the contour of the plug receptacle housing.

14. The power system of claim 1, wherein the commonly configured interface includes a plug and the first interface of the power adapter includes a plug receptacle corresponding to the plug.

* * * * *